United States Patent [19]

Merisio

[11] 4,129,155

[45] Dec. 12, 1978

[54] WEFT CARRYING GRIPPER FOR SHUTTLELESS LOOMS WITH STATIONARY WEFT SUPPLY

[75] Inventor: Alberto Merisio, Colzate (Bergamo), Italy

[73] Assignee: Somet Societa' Meccanica Tessile S.p.A., Gazzaniga (Bergamo), Italy

[21] Appl. No.: 729,367

[22] Filed: Oct. 4, 1976

[30] Foreign Application Priority Data

Oct. 3, 1975 [IT] Italy ..... 27927 A/75

[51] Int. Cl.[2] ..... D03D 47/20

[52] U.S. Cl. ..... 139/448

[58] Field of Search ..... 139/443, 447, 448, 196.2

[56] References Cited

U.S. PATENT DOCUMENTS

| | | | |
|---|---|---|---|
| 3,137,321 | 6/1964 | Wasylewiez | 139/448 |
| 3,580,291 | 5/1971 | Piccoli | 139/448 |
| 3,587,663 | 6/1971 | Juillard | 139/448 |

FOREIGN PATENT DOCUMENTS

| | | | |
|---|---|---|---|
| 2131287 | 12/1972 | Fed. Rep. of Germany | 139/448 |
| 2142581 | 6/1971 | France | 139/448 |

*Primary Examiner*—Henry S. Jaudon

*Attorney, Agent, or Firm*—Young & Thompson

[57] ABSTRACT

A weft carrying gripper for shuttleless looms with stationary weft supply, comprises a lower jaw whose relatively stationary upper surface is adapted to contact the weft. A rigid lever pivoted on the gripper carries a metallic lamina at one end that releasably grips the weft thread between itself and the stationary surface of the lower jaw. The same end of the lever also carries a leaf spring that bears resiliently against the lamina. A further leaf spring at the other end of the lever contacts an adjustable portion of the gripper to swing the lever in a direction to urge the lamina toward its weft-gripping position. That other end of the lever serves as a cam which when depressed releases the weft thread.

2 Claims, 3 Drawing Figures

WEFT CARRYING GRIPPER FOR SHUTTLELESS LOOMS WITH STATIONARY WEFT SUPPLY

BACKGROUND OF THE INVENTION

The U.S. Pat. No. 3,580,291 concerns a weft carrying gripper for shuttleless looms with stationary weft supply, comprising stiff gripper bodies made of plastic synthetic material and elastic metallic elements or elastically working elements assembled on the above mentioned bodies in order to cooperate with parts of stiff bodies for seizing and/or holding the weft. According to said U.S. Pat. No. 3,580,291, the carrying gripper includes a gripper body which comprises a lower claw shortened at the rear end, which includes a middle vertical and longitudinal fin and an upper jaw beveled forwardly as well as downwardly from the rear part to the fore one, on said lower jaw being mounted an elastic yarn checking element which consists of metallic laminae pressed against the above mentioned jaw by means of an adjustable leaf spring.

The aim of this invention is to improve the carrying gripper of the above mentioned type.

SUMMARY OF THE INVENTION

The improvement provides that the leaf spring pressing the weft threads holding laminae against the lower gripper jaw forms the end of a lever which is stiff for the remaining part of its extent and oscillates about its middle point, while the other end is thrust away from said jaw by an adjustable spring.

The leaf spring pressing the laminae against the jaw is preferably forked while the spring acting on the stiff lever end is, in turn, a leaf spring.

Moreover, said end of the lever is outwardly shaped so as to be engaged by a fixed or movable cam which, causing the lever to oscillate, is adapted to remove the engagement of said leaf spring with the laminae and, consequently, also the engagement of the laminae with the lower jaw.

The invention will now be better described in detail according to the enclosed drawing illustrating a preferred embodiment thereof.

DESCRIPTION OF THE PREFERRED EMBODIMENT

Figure 1:
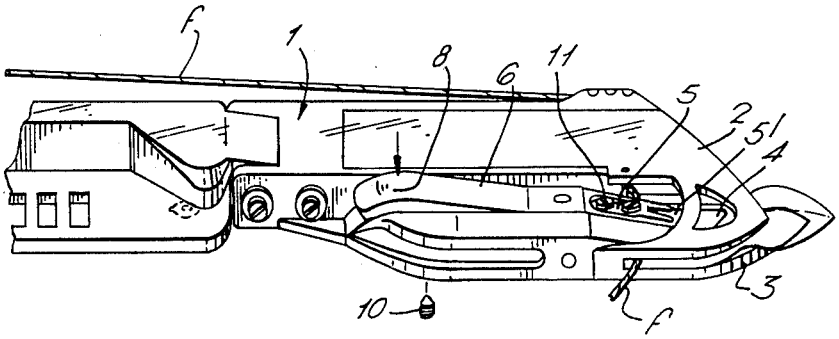
FIG. 1 is a fragmentary perspective view of the carrying gripper according to the invention.

The drawing illustrates the structure of the carrying gripper according to the invention, including a gripper body of plastic material 1 having an upper jaw 2 and a lower claw 3 which has a relatively stationary upper surface against which the weft thread "f" is adapted to be releasably gripped.

According to this invention the holding of the weft thread "f" between the laminae 4 and the lower jaw 3 is achieved by means of a leaf spring 5 which bears at 5' asymmetrically on said laminae. This invention provides for the leaf spring 5 to be secured to the end of a lever 6 stiff for the remaining portion 6 of its extent.

Figure 2:
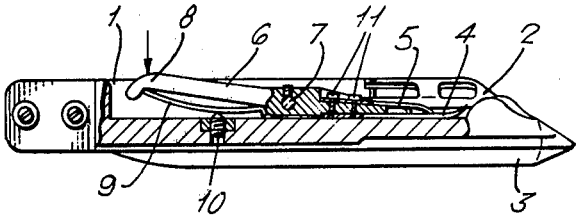
FIG. 2 is a longitudinal section of the gripper and of the weft thread holding laminae with no thread held thereby.
Figure 3:
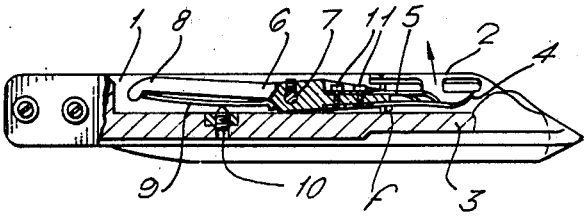
FIG. 3 is a section similar to FIG. 2, but illustrating the position of the laminae holding the weft thread.

Lever 6 is pivoted at 7 on the gripper body 1 and terminates at the other end at 8. This end 8 can be moved away from the lower jaw 3 pressing therefore the leaf spring 5, forming its opposite end, towards the holding laminae 4, by means of a further leaf spring 9 which acts on the lever 6. As seen in FIGS. 2 and 3, laminae 4 are secured to the same end of lever 6 as spring 5 but on the underside thereof.

The action of the leaf spring 9 can be regulated by means of an adjusting screw 10, to be screwed into the lower jaw 3 and adapted to be manipulated from beneath said jaw.

The embodiment herein described illustrates the leaf spring 5 which forms one end of the lever 6 like an elastic plate fixed to the lever 6 by means of two screws 11. Nevertheless the embodiments could be also different, for instance, the spring 5 could be integral with the lever 6.

In the operation inside the shed the gripper works as usual, since the laminae 4 hold the weft thread "f" thanks to the action of the leaf spring 5 (in turn biased via lever 6 by leaf spring 9) which presses the laminae 4 against lower jaw 3.

However according to the invention, the gripper has a non-working position of the laminae 4 holding the weft thread, for example, before it starts the weft picking stroke upstream the presenting device of the loom. A fixed or moving cam (or more generally pressure means) acts on the upwardly emergent end 8 of the lever 6. The latter swings then around the pin 7 from the position shown in FIG. 2 to that of FIG. 3, enabling, in this way, the other end of the lever consisting of the leaf spring 5, to lift, hence releasing from any pressure the laminae 4. These laminae are hence no more apt to hold the weft threads and they partly detach themselves from the lower jaw 3.

I claim:

1. A weft carrying gripper for shuttleless looms with stationary weft supply, comprising a jaw stationary relative to the gripper, a rigid elongated lever pivoted intermediate its length on the gripper, a metallic lamina carried by one end of the rigid lever, a leaf spring carried by the same end of the lever and urging the lamina toward said jaw, and means acting on the other end of the lever yieldably to urge the lever in a direction in which said lamina moves toward said jaw, said lamina and said leaf spring being secured to opposite sides of the same said end of said lever.

2. A gripper as claimed in claim 1, said acting means comprising a further leaf spring that is carried by said lever and that bears against said lever at both of its ends and is spaced from said lever between its ends, and adjustable means carried by the gripper and bearing against said further leaf spring between its ends to adjust the pressure with which said lamina bears against said jaw.

* * * * *